US009909268B2

(12) United States Patent
Wigley

(10) Patent No.: US 9,909,268 B2
(45) Date of Patent: Mar. 6, 2018

(54) DEPLOYMENT APPARATUS

(71) Applicant: FAUN Trackway Limited, North Wales (GB)

(72) Inventor: Neil Wigley, Angelsey (GB)

(73) Assignee: FAUN Trackway Limited, North Wales (GB)

( * ) Notice: Subject to any disclaimer, the term of this patent is extended or adjusted under 35 U.S.C. 154(b) by 0 days.

(21) Appl. No.: 15/460,757

(22) Filed: Mar. 16, 2017

(65) Prior Publication Data

US 2017/0268182 A1 Sep. 21, 2017

(30) Foreign Application Priority Data

Mar. 17, 2016 (GB) ..... 1604523.9

(51) Int. Cl.
*E01C 19/00* (2006.01)
*E01C 19/52* (2006.01)

(52) U.S. Cl.
CPC ..... *E01C 19/522* (2013.01)

(58) Field of Classification Search
CPC ..... E01C 19/522
USPC ..... 404/17, 46, 47, 72, 73, 75, 85, 93, 94
See application file for complete search history.

(56) References Cited

U.S. PATENT DOCUMENTS 1,952,508 A * 3/1934 McConnaughay ... E01C 11/221 404/73
2,393,655 A * 1/1946 Robeck ..... F41H 11/11 180/9
3,258,800 A * 7/1966 Robinsky ..... E01D 15/122 14/2.4
3,459,108 A * 8/1969 Patterson ..... E01C 7/30 404/122
4,277,201 A * 7/1981 Abell ..... E01C 9/086 404/35
4,456,399 A * 6/1984 Conover ..... E01C 23/03 242/557
4,681,482 A * 7/1987 Arciszewski ..... E01C 9/08 14/2.4
4,684,289 A * 8/1987 Gnesa ..... E01C 11/005 404/75

(Continued)

FOREIGN PATENT DOCUMENTS

AU 2009201300 10/2010
CA 2639685 4/2009

(Continued)

OTHER PUBLICATIONS

Search Report under Section 17(5), dated Sep. 15, 2016, Intellectual Property Office, United Kingdom.

*Primary Examiner* — Raymond W Addie
(74) *Attorney, Agent, or Firm* — Seth Ostrow; Meister Seelig & Fein LLP

(57) ABSTRACT

A deployment apparatus for laying a traversable road covering track, the apparatus comprising a base, a spool mounted for rotation on said base, wherein a length of road covering track may be provided on said spool in a roll having a leading outer end at a first longitudinal side of said spool, the apparatus further comprising at least one substantially rigid arm that extends upwardly from said base, at a second, opposing longitudinal side of said spool, such that at least an upper end of said arm is adjacent to the outer surface of said roll, in use.

20 Claims, 6 Drawing Sheets

(56) References Cited

U.S. PATENT DOCUMENTS

| | | | | |
|---|---|---|---|---|
| 4,793,731 | A * | 12/1988 | Gnesa | E01C 11/005 156/575 |
| 5,275,502 | A * | 1/1994 | Glaza | E01C 9/083 404/35 |
| 6,264,400 | B1 * | 7/2001 | Gent | A01G 13/0287 405/129.75 |
| 6,299,094 | B1 | 10/2001 | James, Jr. | |
| 6,786,446 | B1 * | 9/2004 | Kaul | A01G 13/0287 242/557 |
| 7,086,445 | B2 * | 8/2006 | Curry | B09B 1/004 160/243 |
| 7,316,521 | B2 * | 1/2008 | Shiomoto | E01C 23/03 156/497 |
| 7,546,654 | B2 * | 6/2009 | Carmel | E01D 15/122 14/2.4 |
| 8,784,002 | B2 * | 7/2014 | Ringus | E01C 9/02 14/2.5 |
| 8,784,007 | B2 * | 7/2014 | Wilson | B09B 1/004 242/557 |
| 2003/0223815 | A1 * | 12/2003 | Polivka, Jr. | E01C 9/086 404/75 |
| 2009/0274516 | A1 * | 11/2009 | Colkitt | E01C 23/04 404/75 |
| 2015/0252538 | A1 * | 9/2015 | Muratov | E01C 21/00 404/99 |

FOREIGN PATENT DOCUMENTS

| | | |
|---|---|---|
| DE | 3330098 | 3/1985 |
| WO | WO97/34050 | 9/1997 |
| WO | WO99/09255 | 2/1999 |

* cited by examiner

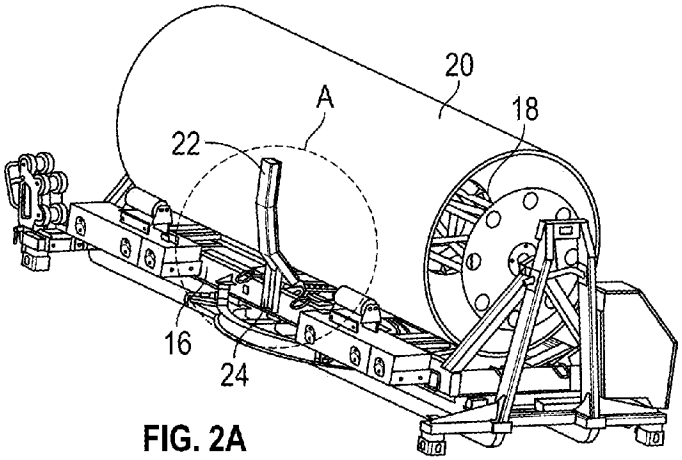
FIG. 2B
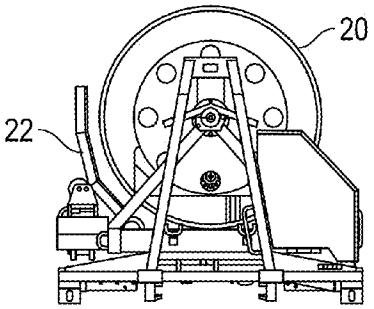
FIG. 2D
FIG. 2A
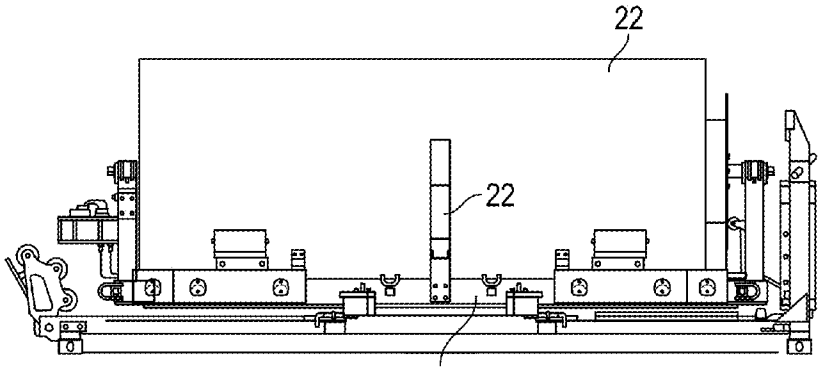
FIG. 2C

DEPLOYMENT APPARATUS

CROSS REFERENCE TO RELATED APPLICATION

This application claims the priority of British Patent Application No. GB1604523.9, entitled "DEPLOYMENT APPARATUS," filed on Mar. 17, 2016, the disclosure of which is hereby incorporated by reference in its entirety.

BACKGROUND OF THE INVENTION

Field of the Invention

This invention relates generally to deployment apparatus for coiled or rolled resources and more particularly, but not necessarily exclusively, to deployment apparatus for laying and recovery of road covering track normally stored in a rolled configuration such as, for example, a traversable temporary roadway, walkway or runway.

Description of the Related Art

It is known, in many applications, to transport and deploy a temporary roadway system, wherein a road-covering track comprising interconnected profiled panels, is wound around a spool into a roll. In a known deployment method, the spool may be mounted, via a spool stand, on a flatbed body or trailer of a heavy goods vehicle, such that the winding axis of the spool is perpendicular to the longitudinal axis of the vehicle body. As illustrated in FIG. 1 of the drawings, the road-covering track 1 is drawn off the spool 2 and a pair of chains and straps 5, which are attached at the end of the track 1, are positioned under the vehicle's rear wheels 4, over a pair of rollers 4*a*, as shown in FIG. 1A of the drawings. The vehicle 3 then reverses, placing the chains/straps 5 under tension and causing the road-covering track 2 to be removed from the rotating spool 2 and laid onto the ground.

Other methods for deployment of this type of road-covering track are also known, that employ vehicles such as a tele-handler or wheeled loader, but they all operate in much the same manner as described above, whereby a constant tensioning device is used to automatically lay the roadway in tension and the laying process is determined by the speed of the moving vehicle. An alternative method of deployment may be performed by means of a remote control device that requires the operator and driver to synchronise the speed of vehicle travel with the speed of spool rotation. The operator depresses the spool rotation button on the pendant control to correspond with the travelling speed of the vehicle. If the electrical system fails, the operator can use hydraulic manual override levers to rotate the spool and, if complete hydraulic failure occurs, the operator can operate a manual handpump to release the spool rotation and the roadway can be manually pulled from the spool and placed under the vehicle's wheels.

In all of these cases, it normally requires at least two people to set up the deployment apparatus for use, namely the driver and an operator, and the process can be time consuming and awkward. There are many commercial and military applications in which a temporary road covering track of this type is required to be deployed and subsequently recovered, quickly and conveniently, especially within rough terrain and/or potentially hazardous environments, where speed and efficiency are paramount, without necessarily requiring two or more operatives to effect such deployment.

SUMMARY OF THE INVENTION

It is an object of aspects of the present invention to address at least some of these issues and, in accordance with a first aspect of the present invention, there is provided a deployment apparatus for laying a traversable road covering track, the apparatus comprising a base, a spool mounted for rotation on said base, wherein a length of road covering track may be provided on said spool in a roll having a leading outer end at a first longitudinal side of said spool, the apparatus further comprising at least one substantially rigid arm that extends upwardly from said base, at a second, opposing longitudinal side of said spool, such that at least an upper end of said arm is adjacent to the outer surface of said roll, in use.

In a first exemplary embodiment, a single arm may be provided at a location substantially half way along the length of said second longitudinal side of said spool. In an alternative exemplary embodiment, at least two arms may be provided at locations substantially adjacent to opposing ends of said longitudinal side of said spool. However, it will be appreciated by a person skilled in the art that any number of deployment arms may be provided, and the present invention is not necessarily intended to be limited in this regard. It is also to be understood that the term 'arm' used herein is not intended to limit the configuration of this element of the apparatus—the 'arm' could, for example, be wider than it is long and still perform the same function.

In an exemplary embodiment, the arm may comprise at least two connected or integral arm sections. The arm sections may, in this case, comprise respective elongate bars coupled, joined or formed integrally at adjoining ends, said arm sections being angularly oriented relative to each other.

More generally, in an exemplary embodiment, an inner profile of said arm may generally define a curve having a radius substantially matching, or greater than, the radius of said roll so as to accommodate the roll in a space defined between said inner profile and said spool. Thus, in theory, the arm could be formed in a single, curved section to accommodate this profile.

Optionally, the upper end of said arm may terminate at a height substantially half way, or more, up the roll, in use. The or each arm may comprise at least three connected or integral arm sections. In this case, the arm sections may, once again, comprise respective elongate bars coupled, joined or formed integrally at adjoining ends, said arm sections being angularly oriented relative to each other.

The apparatus may further comprise an upright strut, coupled between said base and said arm.

In accordance with another aspect of the present invention, there is provided a heavy wheeled or tracked vehicle having mounted thereon a deployment apparatus substantially as described above.

BRIEF DESCRIPTION OF THE DRAWINGS

These and other aspects of the invention will be apparent from the following specific description, in which embodiments of the present invention are described, by way of examples only, and with reference to the accompanying drawings, in which:

FIG. 2A is a schematic perspective view of deployment apparatus according to a first exemplary embodiment of the present invention;

FIG. 2B is a close-up view of section A in FIG. 2A;

FIG. 2C is a schematic side view of the deployment apparatus of FIG. 2A;

FIG. 2D is a schematic rear view of the deployment apparatus of FIG. 2A;

DETAILED DESCRIPTION OF THE INVENTION

Figure 1:
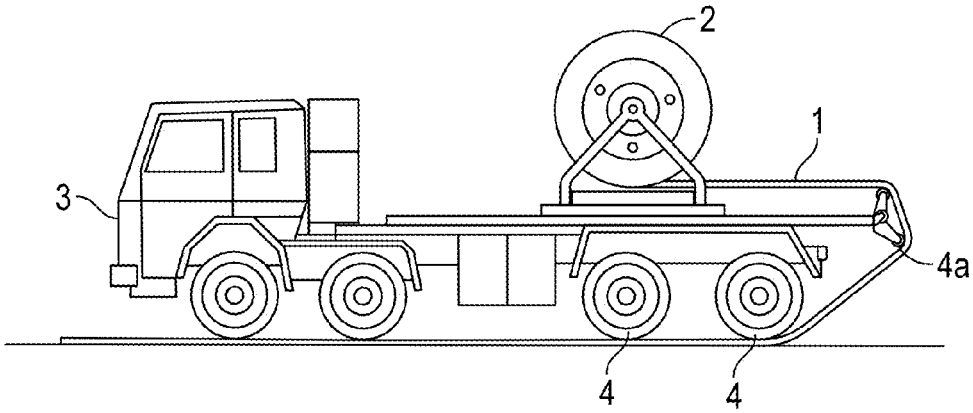
FIG. 1 (Prior Art)
FIG. 1 is a schematic perspective view of a conventional heavy goods vehicle in a method of deployment of a surface-covering track according to an example of the prior art.
Figure 1A:
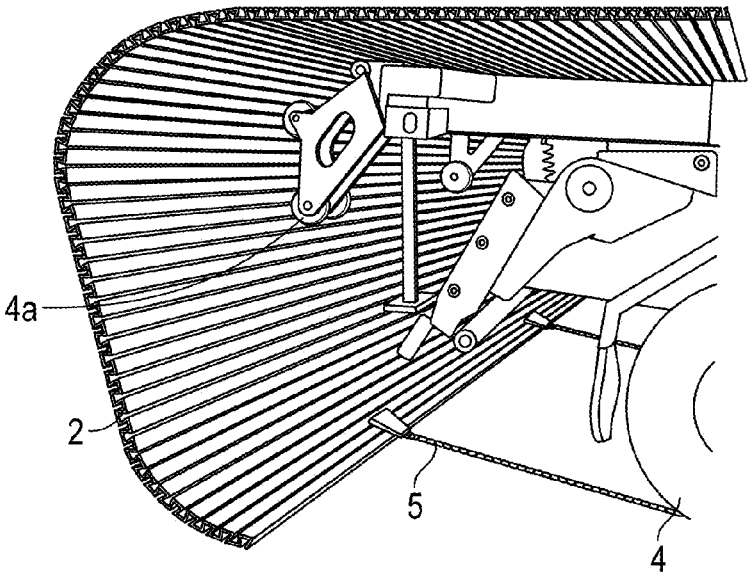
FIG. 1A (Prior Art)
FIG. 1A is a close-up partial view illustrating a conventional method of deployment of a surface-covering track according to an example of the prior art.
Figure 2:
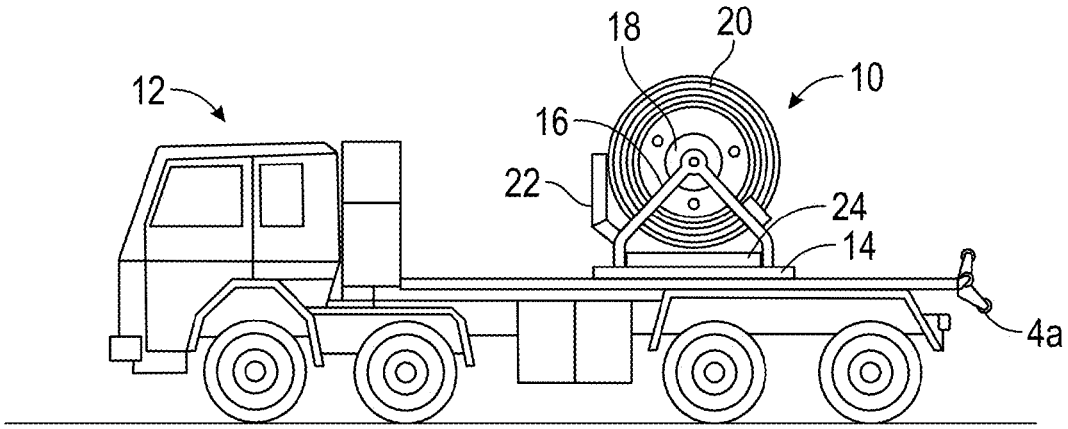
FIG. 2 is a schematic side view of a heavy goods vehicle having mounted thereon deployment apparatus according to a first exemplary embodiment of the present invention, wherein the spool stand is in the transportation configuration.
Figure 3:
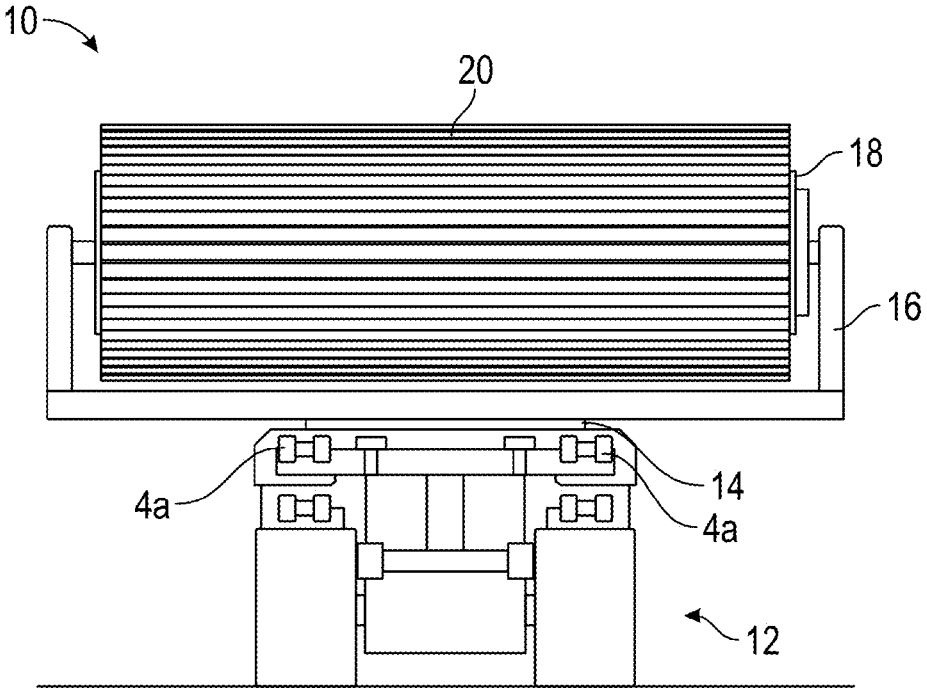
FIG. 3 is a schematic rear view of the Heavy goods vehicle of FIG. 2, illustrating the spool stand of the deployment apparatus in the deployment configuration.

Referring to FIG. 2 of the drawings, a mobility and deployment system 10 for a heaving tracked or wheeled vehicle 12 comprises a frame 14 mounted on the bed of the vehicle 12. On the frame 14, a spool stand is mounted for rotation about its vertical axis between the transportation configuration illustrated in FIG. 2, wherein the longitudinal axis of the spool stand is substantially parallel to the longitudinal axis of the vehicle 12, and the deployment configuration illustrated in FIG. 3 of the drawings, in which the longitudinal axis of the spool stand 16 is substantially orthogonal to the longitudinal axis of the vehicle 12.

A spool 18 is mounted on the spool stand for rotation about an axis parallel to the above-mentioned longitudinal axis of the spool stand 16. The spool 18 is supported at each end of the spool stand 16 and rotates on bearing surfaces. A length of road covering track 20 is mounted in a rolled configuration on the spool 18.

As shown in FIG. 2 of the drawings, in a first exemplary embodiment of the present invention, a single deployment arm 22 is provided, which is coupled to the spool stand 16, and supported by an elongate, generally upright strut 24. The strut 24 extends substantially vertically from the side edge of the spool stand 16, at a location substantially half way along the longitudinal edge thereof that is nearest the front of the vehicle 12 when the spool stand 16 is in the above-mentioned deployment configuration (such that it cannot be seen behind the spool 18 and roll 20 from the rear of the vehicle in FIG. 3, when the spool stand is in the deployment configuration).

As can be best seen in FIGS. 2A, 2B, 2C and 2D of the drawings, the deployment arm 22 is rigidly coupled at, or formed integrally with, the upper end of the strut 24, and comprises three integral elongate arm sections, namely a lower arm section 22*a*, an intermediate arm section 22*b* and an upper arm section 22*c*. The lower arm section 22*a* extends upwardly and outwardly at an angle from a location adjacent an inner side edge of the above-mentioned longitudinal edge of the spool stand 16 and meets the upper end of the strut 24 at a location on its outer edge, close to the top of the lower arm section 22*a*. The intermediate arm section 22*b* extends from the top of the lower arm section 22*a* at an angle (relative to a nominal vertical axis) that is less than that at which the lower arm section 22*a* extends outwardly. The upper arm section 22*c* extends upward substantially vertically (or even slightly angularly toward the roll of track 20) from the upper end of the intermediate arm section 22*b*. As a result of the above-mentioned configuration, the inner wall of the deployment arm 22 effectively follows a 'curve' from the point at which the lower arm section 22*a* meets the spool stand 16, outwardly and upwardly to the upper end of the upper arm section 22*c*, the radius of the 'curve' generally matching that of the fully rolled track 20. In general, the deployment arm 22 needs only to be shaped and configured (in respect of its inner wall, i.e. the wall thereof that is immediately adjacent the rolled track 20) such that it extends outwardly (i.e. toward the front of the vehicle 12 when the spool stand 16 is in the deployment configuration) from where it is joined or coupled to the spool stand 16 (or frame 14), to ensure that the resultant space between the inner wall of the deployment arm 22 and the spool 18 is sufficient to accommodate the fully rolled track 20, and upwardly to terminate at a height around half way (or more) up the roll (as can be seen from FIG. 3 of the drawings). In theory, the deployment arm could be a single arm section either curved into the required profile to accommodate the roll, or it could extend substantially vertically upward along its entire length, provided its lower end is coupled to the frame/spool stand at a location that is sufficiently far back from the outer surface of the roll.

The upper arm section 22*c* is generally vertical relative to (or even angled slightly toward) the roll, with its inner wall adjacent to (i.e. very close to or even just touching) the outer surface of the track 20 in the fully rolled configuration, but without exerting any significant force or pressure thereon when it is at rest.

Figure 4:
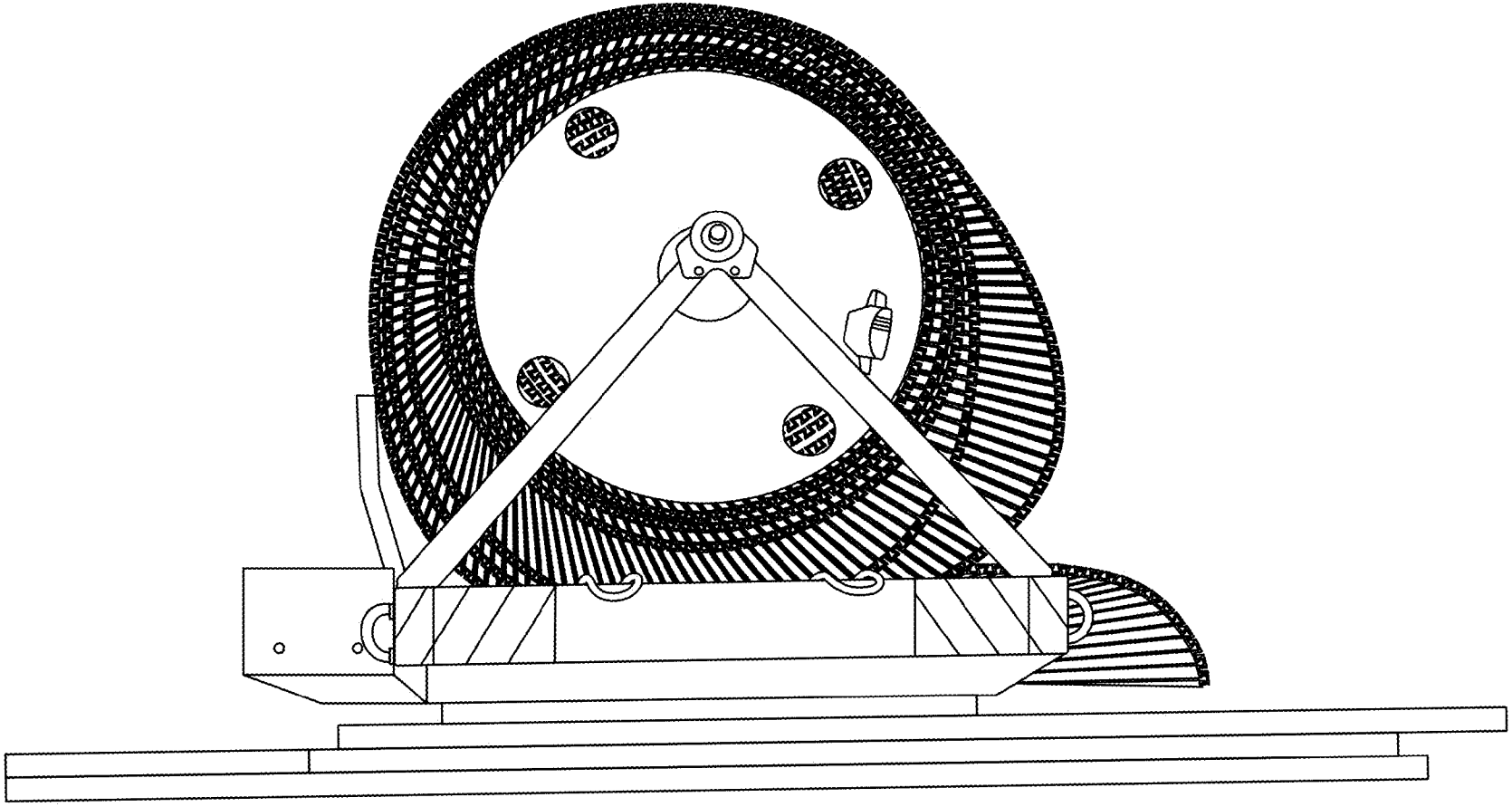
FIG. 4 is an image illustrating the apparatus of FIGS. 2 and 3 in the first stages of deployment of the surface-covering track.
Figure 5A:
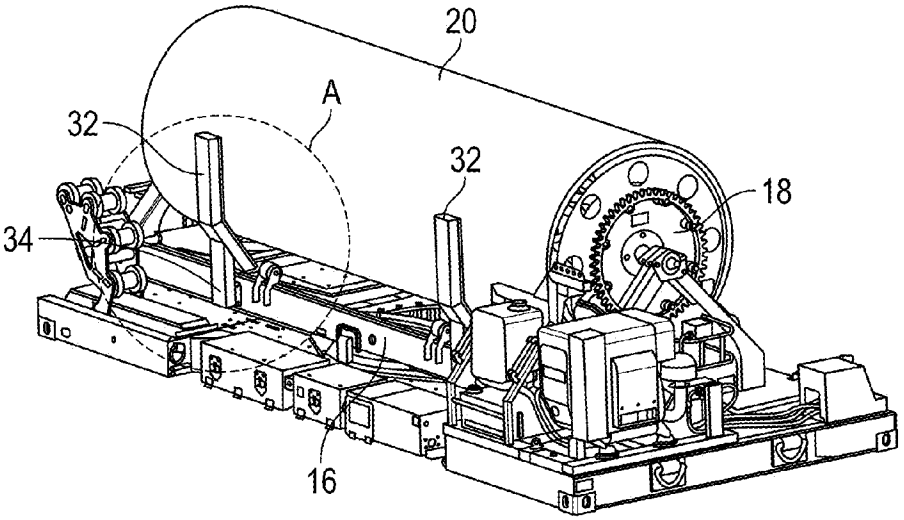
FIG. 5A is a schematic perspective view of deployment apparatus according to a second exemplary embodiment of the present invention.
Figure 5B:
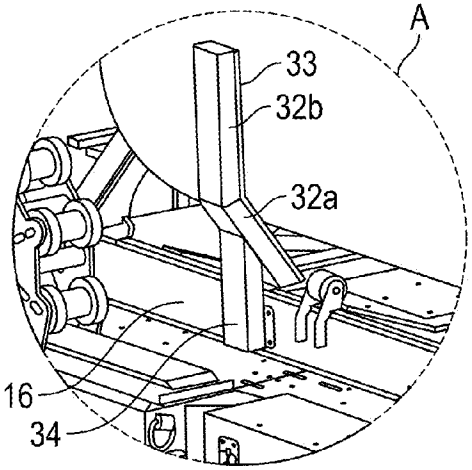
FIG. 5B is a close-up view of section A in FIG. 5A.
Figure 5C:
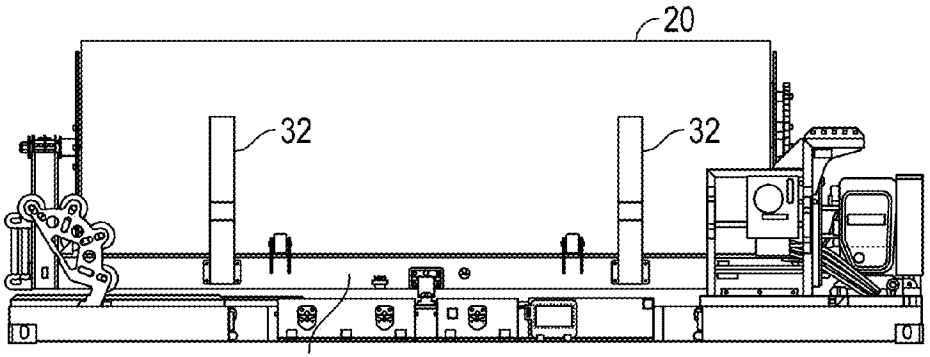
FIG. 5C is a schematic side view of the deployment apparatus of FIG. 5A.
Figure 5D:
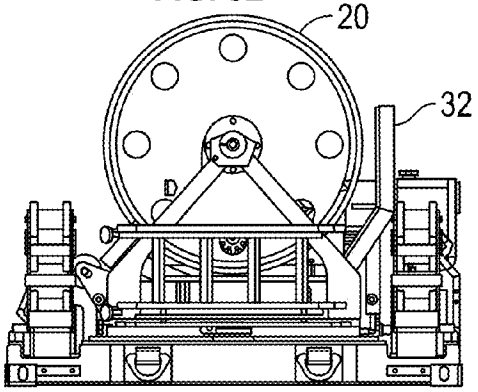
FIG. 5D is a schematic rear view of the deployment apparatus of FIG. 5A.

Referring to FIG. 4 of the drawings, in use, when the spool 18 is rotated (either by an operative pulling the free end of the track 20 (manually) or by means of a motor or the like, the free end of the track is released from the roll and fed out (toward the rear of the vehicle 12). Without any tension being applied to the end of the track, the net effect of this rotation is that the roll starts to unravel at the rear (i.e. the side nearest the front of the vehicle 12). However, in this case, any such unraveling is counteracted by the upper arm section 22*c* of the deployment arm 22, which, when the track 20 starts to unravel toward it, has the effect of exerting a radial force thereon (toward the spool 18), thereby pushing the leading edge of the track 20 in the opposite direction, toward the rear of the vehicle 12, and ensuring that the end of the track 20 is correctly fed from the spool 18.

Once the end of the track 20 clears the rear edge of the frame 14 and the rear end of the vehicle 12, gravity acts on it to pull it downwardly toward the ground, thereby applying tension thereto. When the end of the track 20 has dropped to the ground, the vehicle 12 can reverse onto it, and as the vehicle continues to reverse, the remaining length of track 20 is pulled from the spool 18 and laid on the ground beneath the vehicle wheels.

Referring to FIGS. 5A, 5B, 5C and 5D of the drawings, a deployment apparatus according to a second exemplary embodiment is illustrated, in which a pair of deployment arms 32 is provided, the deployment arms 32 being substantially identical and located close to opposing ends of the spool stand 16, spaced apart from one another along the rear longitudinal edge thereof (i.e. the edge nearest the rear of the vehicle when the spool stand 16 is in the above-mentioned deployment configuration).

Once again, and in respect of each deployment arm 32, an upright strut 34 extends vertically upwardly from the outer edge of the spool stand 16 (or frame 14), but in this case, each deployment arm 32 comprises two integral arm sections, namely a lower arm section 32*a* and an upper arm section 32*b*. The lower arm section 32*a* extends upwardly and outwardly at an angle from a location adjacent an inner side edge of the above-mentioned longitudinal edge of the spool stand 16 and meets the upper end of the strut 34 at a location on its outer edge, close to the top of the lower arm section 32*a*. The upper arm section 32*b* extends substantially vertically upwardly to a point around halfway (or more) up the roll of track 20. In other exemplary embodiments, the upper arm section 32*b* may, once again, alternatively be angled slightly toward the roll of track 20.

Figure 6:
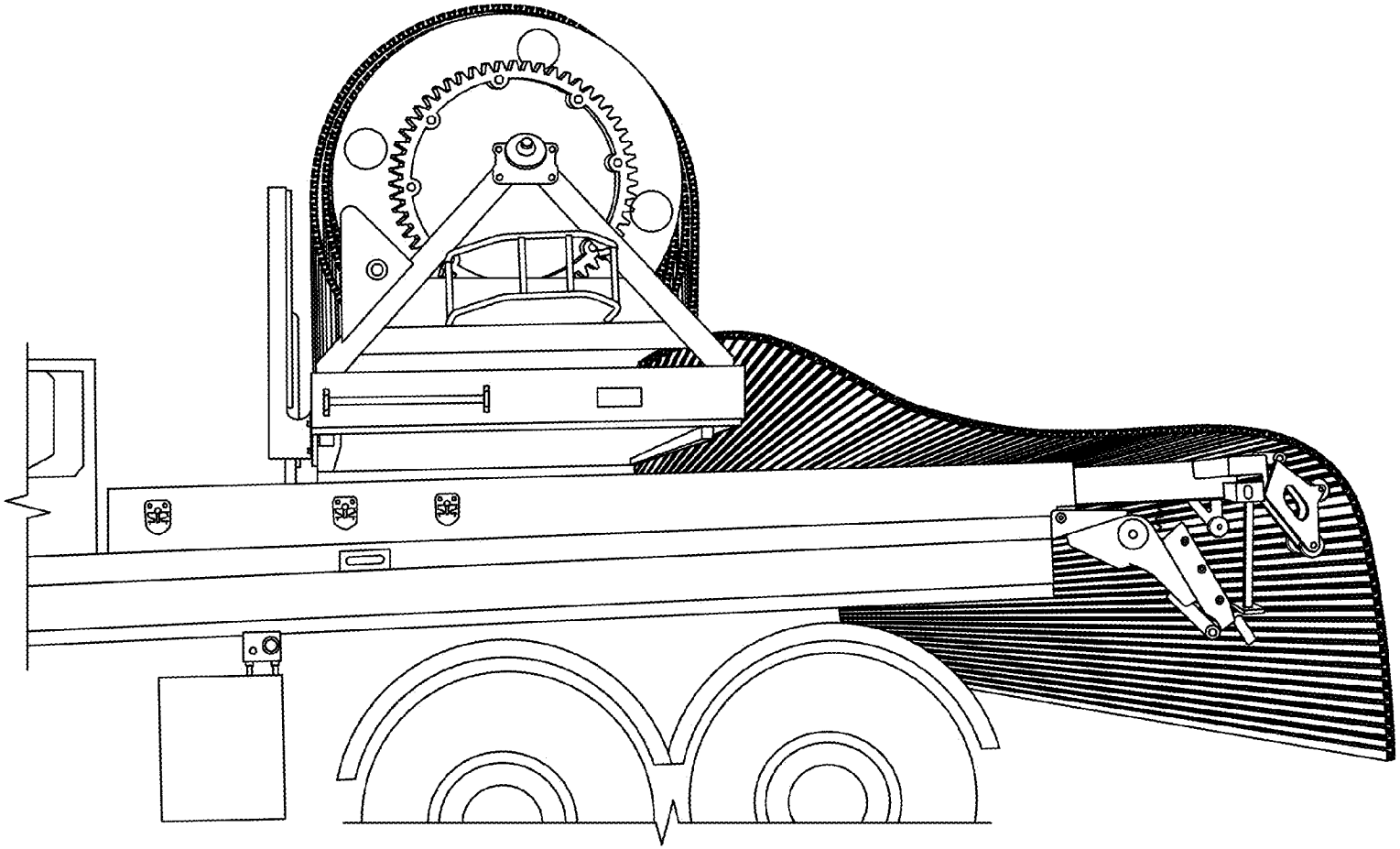
FIG. 6 is an image illustrating the apparatus of FIGS. 5A-5D in the first stages of deployment of the surface-covering track.

As before, in use and referring to FIG. 6 of the drawings, when the spool 18 is rotated (either by an operative pulling the free end of the track 20 (manually) or by means of a motor or the like, the free end of the track is released from the roll and fed out (toward the rear of the vehicle 12). Without any tension being applied to the end of the track, the net effect of this rotation is that the roll starts to unravel at the rear (i.e. the side nearest the front of the vehicle 12). However, in this case, any such unraveling is counteracted by the upper arm sections 32*b* of the deployment arms 32, which, when the track 20 starts to unravel toward it, have the effect of exerting a radial force thereon (toward the spool 18), thereby pushing the leading edge of the track 20 in the opposite direction, toward the rear of the vehicle 12, and ensuring that the end of the track 20 is correctly fed from the spool 18.

In the case of both the first and second exemplary embodiments described above, a low friction layer or coating 33, e.g. low friction sacrificial plastic or even rolling wheels may be provided on the inner surface of the or each deployment arm, to provide a low-friction interface between the deployment arm(s) and the outer surface of the track 20, in use.

It will be apparent to a person skilled in the art, from the foregoing description, that modifications and variations can be made to the described embodiments without departing from the scope of the invention as defined by the appended claims.

The invention claimed is:

1. A deployment apparatus for laying a traversable road covering track, the apparatus comprising:

a base, a spool mounted for rotation on said base and configured, in use, to receive a length of road covering track thereon in a roll having a leading outer end at a first longitudinal side of said spool, and at least one substantially rigid arm that extends upwardly from said base, at a second, opposing longitudinal side of said spool, such that at least an upper end of said arm is adjacent to the outer surface of said roll and counteracts an unraveling of said track towards at least said upper end of said arm by exerting a radial force toward said spool, said arm being fixed relative to said base and said spool when in use.

2. Apparatus according to claim 1, wherein a single arm is provided at a location substantially half way along the length of said second longitudinal side of said spool.

3. Apparatus according to claim 1, wherein at least two arms are provided at locations substantially adjacent to opposing ends of said longitudinal side of said spool.

4. Apparatus according to claim 1, wherein said arm comprises at least two connected or integral arm sections.

5. Apparatus according to claim 4, wherein the arm sections comprise respective elongate bars coupled, joined or formed integrally at adjoining ends, said arm sections being angularly oriented relative to each other.

6. Apparatus according to claim 1, wherein said arm is mounted so as to define a lateral gap between its inner profile and the spool, said gap being sufficiently wide to accommodate said roll, in use.

7. Apparatus according to claim 1, wherein an inner profile of said arm generally defines a curve having a radius substantially matching, or greater than, the radius of said roll so as to accommodate the roll in a space defined between said inner profile and said spool.

8. Apparatus according to claim 1, wherein said upper end of said arm terminates at a height substantially half way, or more, up the roll, in use.

9. Apparatus according to claim 1, wherein said arm comprises at least three connected or integral arm sections.

10. Apparatus according to claim 9, wherein the arm sections comprise respective elongate bars coupled, joined or formed integrally at adjoining ends, said arm sections being angularly oriented relative to each other.

11. Apparatus according to claim 1, comprising a fixed upright strut, coupled between said base and said arm.

12. Apparatus according to claim 1, further comprising a heavy wheeled or tracked vehicle having mounted thereon the deployment apparatus.

13. A method for operating a deployment apparatus for laying a traversable road covering track, the deployment apparatus comprising a base, a spool mounted for rotation on said base and configured, in use, to receive a length of road covering track thereon in a roll having a leading outer end at a first longitudinal side of said spool, and at least one substantially rigid arm that extends upwardly from said base, at a second, opposing longitudinal side of said spool, such that at least an upper end of said arm is adjacent to the outer surface of said roll and counteracts an unraveling of said track towards at least said upper end of said arm by exerting a radial force toward said spool, said arm being fixed relative to said base and said spool when in use, the method comprising:

rotating said spool to release a free end of said track from said spool at said leading outer end at a first longitudinal side of said spool, and counteracting the rotation of said spool by said upper end of said arm exerting a radial force on said spool.

14. The method of claim 13 wherein counteracting the rotation of said spool further comprises pushing the free end of said track toward said opposing longitudinal side of said spool.

15. The method of claim 13 further comprising deflecting at least a portion of the track that unravels at the leading outer end at the first longitudinal side.

16. The method of claim 13 further comprising mounting said arm so as to define a lateral gap between its inner profile and the spool, said gap being sufficiently wide to accommodate said roll, in use.

17. A deployment apparatus for laying a traversable road covering track, the apparatus comprising:

a base, a spool mounted for rotation on said base and configured, in use, to receive a length of road covering track thereon in a roll having a leading outer end at a first longitudinal side of said spool, and at least one substantially rigid arm that extends upwardly from said base, at a second, opposing longitudinal side of said spool, such that at least an upper end of said arm is adjacent to the outer surface of said roll and counteracts an unraveling of said track towards at least said upper end of said arm by exerting a radial force toward said spool, said arm being fixed relative to said base and said spool when in use, and an inner profile of said arm generally defines a curve having a radius substantially matching, or greater than, the radius of said roll so as to accommodate the roll in a space defined between said inner profile and said spool.

18. Apparatus according to claim 17, wherein a single arm is provided at a location substantially half way along the length of said second longitudinal side of said spool.

19. Apparatus according to claim 17, further comprising a fixed upright strut coupled between said base and said arm.

20. Apparatus according to claim 17, wherein said upper end of said arm terminates at a height substantially half way, or more, up the roll, in use.

* * * * *